US009821985B2

(12) United States Patent
Willim

(10) Patent No.: US 9,821,985 B2
(45) Date of Patent: Nov. 21, 2017

(54) CRANE HAVING A MODULAR UNDERCARRIAGE

(71) Applicant: Liebherr-Werk Ehingen GmbH, Ehingen (DE)

(72) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 47 days.

(21) Appl. No.: 14/576,603

(22) Filed: Dec. 19, 2014

(65) Prior Publication Data

US 2015/0183622 A1 Jul. 2, 2015

(30) Foreign Application Priority Data

Dec. 20, 2013 (DE) ..... 10 2013 021 916

(51) Int. Cl.

| | |
|---|---|
| ***B66C 23/36*** | (2006.01) |
| ***B66C 23/62*** | (2006.01) |
| ***B66C 23/80*** | (2006.01) |
| ***B66C 9/00*** | (2006.01) |

(52) U.S. Cl.

CPC ..... *B66C 23/36* (2013.01); *B66C 9/00* (2013.01); *B66C 23/62* (2013.01); *B66C 23/80* (2013.01)

(58) Field of Classification Search

CPC ..... B66C 23/36; B66C 23/62; B66C 23/80; B66C 9/00

USPC ..... 212/232

See application file for complete search history.

(56) References Cited

U.S. PATENT DOCUMENTS 3,638,805 A * 2/1972 Garnier ..... B66C 23/62 180/9.52

4,555,031 A * 11/1985 Blase ..... B66C 23/78 180/22

FOREIGN PATENT DOCUMENTS

DE EP 0919508 A2 * 6/1999 ..... B66C 23/54

DE 102008047737 A1 4/2010

DE 202010002947 U1 8/2011

* cited by examiner

*Primary Examiner* — Sang Kim

*Assistant Examiner* — Juan Campos, Jr.

(74) *Attorney, Agent, or Firm* — McCoy Russell LLP

(57) ABSTRACT

The invention relates to a crane having an undercarriage with a swivel connection and having a superstructure rotatably supported thereon via the swivel connection and comprising at least one boom system arranged at said superstructure and luffable about a luffing axis or a self-climbing tower slewing crane rotatably supported thereon via the swivel connection. In accordance with the invention, the undercarriage has a pot as a central component which, on the one hand, receives the swivel connection. Furthermore, however, the pivotable supports can also be pivotally connected to it. Side members are present at mutually oppositely disposed sides and at least one traveling gear can respectively connected to them with at least one degree of freedom.

20 Claims, 15 Drawing Sheets

FIG. 8A
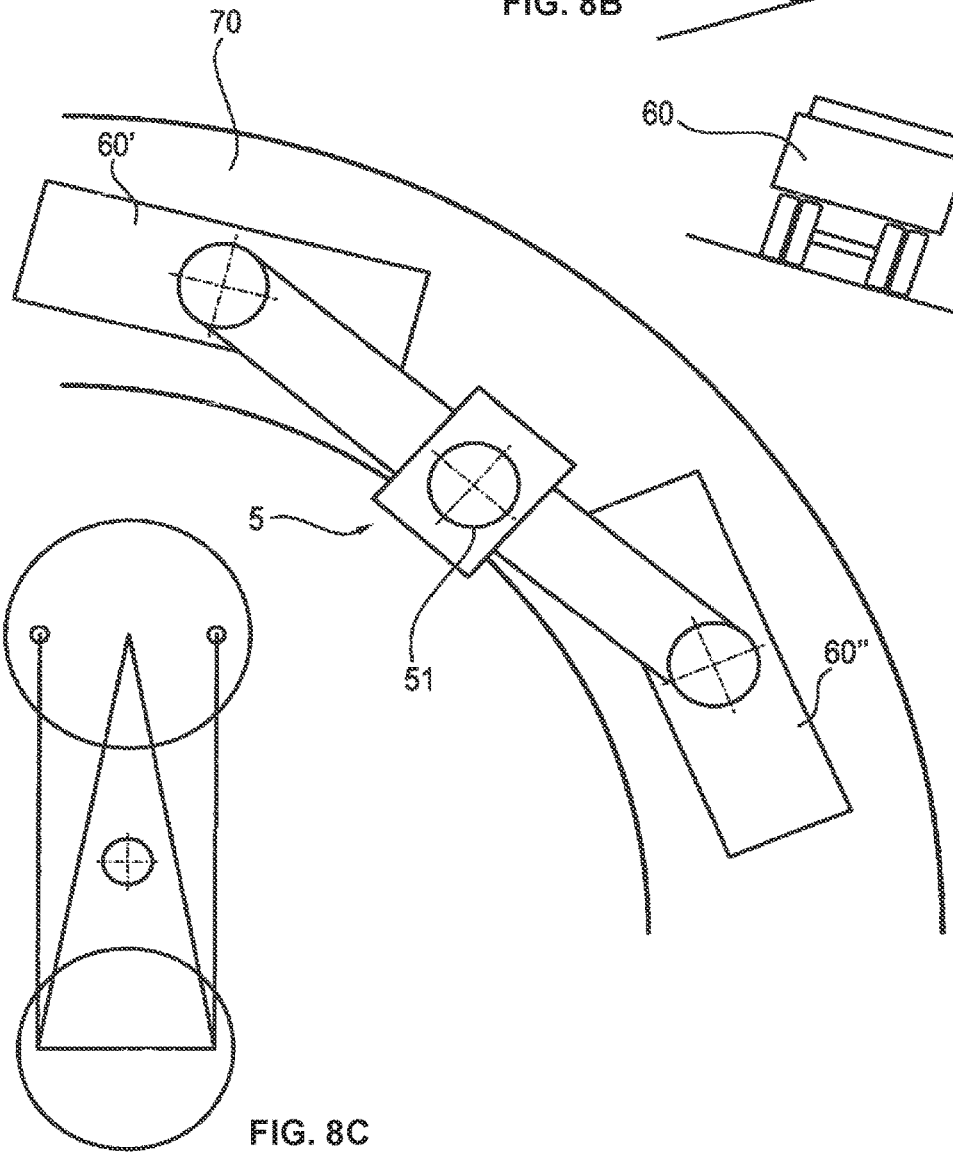
FIG. 8B
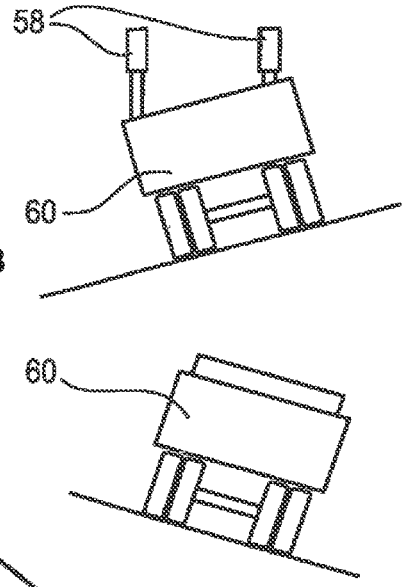
FIG. 8C

CRANE HAVING A MODULAR UNDERCARRIAGE

CROSS REFERENCE TO RELATED APPLICATIONS

This application claims priority to German Patent Application No. 10 2013 021 916.7, entitled "Crane," filed Dec. 20, 2013, which is hereby incorporated by reference in its entirety for all purposes.

TECHNICAL FIELD

The invention relates to a crane having an undercarriage with a swivel connection and having a superstructure rotatably supported thereon via the swivel connection and comprising at least one boom system arranged at said superstructure and luffable about a luffing axis or a self-climbing tower slewing crane rotatably supported thereon via the swivel connection.

BACKGROUND AND SUMMARY

There are various forms of cranes which can be divided as follows into three types, for example. The first type is that of mobile cranes which travel independently on the road. The traveling gears of the mobile cranes are raised from the ground with a large support at the construction site so that a large support base is produced with tilt edges which lie far apart. The bearing pressure under these supports is distributed almost homogeneously.

A further crane type is the crawler-mounted crane which has to be moved as a separate transport product on the road. The crawler-mounted crane can, however, move independently on the construction site. An inhomogeneous distribution of the ground pressure is produced beneath the base plate of the crawler.

Finally, as the third crane type, there is the so-called pedestal crane. This is also moved as transport product on the road. This pedestal crane is stationary at the construction site. It also has to be set up each time at every deployment location at the construction site.

Each of the aforesaid three types has advantages and disadvantages.

A mobile crane which has a modular design is already known from DE 10 2008 047 737, A1. It includes a platform module, an equipping module and a drive module as well as a support module. The modules can each be assembled and dismantled again.

A crane is known from DE 20 2010 002 947, U1, which positions a single-axle all-terrain dolly beneath the boom for travelling. The single-axle all-terrain dolly takes up the head weight of the boom.

It is the object of the invention to provide a mixed form of the initially named different crane types in which the advantages are utilized and the existing disadvantages are avoided as much as possible.

This object is solved in accordance with the invention by a crane in accordance with this disclosure. A crane is provided having an undercarriage with a swivel connection and having a superstructure rotatably supported thereon via the swivel connection and comprising at least one boom system arranged at said superstructure and luffable about a luffing axis or a self-climbing tower slewing crane rotatably supported thereon via the swivel connection. In accordance with the invention, the undercarriage has a pot as a central component which, on the one hand, receives the swivel connection. Furthermore, however, the pivotable supports can also be pivotally connected to it. Side members are present at mutually oppositely disposed sides and at least one traveling gear can respectively be connected to them with at least one degree of freedom.

A number of advantages of the initially named crane types can be realized with this conceptually newly designed crane. The new undercarriage concept can thus be set up on the construction site as a stationary base of a very stable design. After a corresponding setup, the traveling gear can be separated. After the separation of the traveling gear, it can, for example, take over another task at the construction site, for example in the form of a heavy load transporter.

On the other hand, the pot can selectively be connected to different traveling gears via the corresponding side members and the connections provided thereat to move the crane. On the one hand, it could be a track traveling gear which is advantageous for the movement of the crane on the construction site. On other hand, however, a wheel traveling gear can also be used.

Particular advantages of the invention result from other aspects of this disclosure.

Both the support and the side members can advantageously be releasably connected to the pot. This is in particular indicated with very large cranes in which the individual parts also have to be transported separately from one another.

In the same manner, it is advantageous that the side members are releasably connected to the traveling gears. This allows the replacement of the traveling gears or the decoupling of the traveling gears during stationary crane operation.

In accordance with another advantageous embodiment of the invention, the pot can be divided into two, with each part of the pot being releasably connected to a traveling gear via side members.

After their connection, the two parts of the divided pot form the swivel connection together with a revolving deck frame.

The releasable connection between the side members and the traveling gears advantageously takes place in that transverse struts having sliding shoes, rolls and/or rollers are arranged at the side members and cooperate with complementary ring elements at the traveling gear side such that the traveling gears can rotate beneath the side members.

The ring elements can advantageously be arranged on the traveling gear via a controlled three-point support or four-point support, with these advantageously comprising three hydraulic cylinders via which the ring element can be held in a horizontal position largely independently of the position of the traveling gear. A safe moving of the crane can hereby also be made possible off-road. This is in particular important when the crane is moved over a comparatively bumpy travel path off-road with comparatively widely spaced apart traveling gears.

It is of particular advantage if the traveling gears are configured in the form of modular heavy load transport vehicles. They can be driven or they can be not driven, with in particular the not-driven heavy load transport vehicles also being able to be adjustable in their widths in a manner known per se. It is very particularly advantageous, especially for transport on the construction site, that crawler travel gears are used as traveling gears. The advantage of a crawler traveling gear here is that it exerts a much more uniform bearing pressure on the ground than a comparable wheel traveling gear would. The crawler traveling gear is also of particular advantage with respect to the problem of the maximum axial load distribution on the travel path. The axial load of the wheel traveling gear namely has to be considered with corresponding wheel traveling gears. This very easily exceeds the permitted axial load (of, for example, 12, metric tons), in particular on the transport of large cranes.

The boom can particularly advantageously be supported via a separate additional traveling gear during movement. In this respect, the traveling gear can be coupled via correspondingly movable connection elements.

It is of advantage with respect to a particularly stable support if the supports are configured as lattice constructions which in this respect are also advantageously substantially designed with the same height as the pot itself. The supports configured as lattice designs have a particularly high stiffness. If they are designed exactly as high as the pot, the maximum transport height is also utilized so that in especially stable supports can in particular also be provided for the use of large cranes.

In accordance with a further advantageous embodiment of the invention, a control is provided for the common control of the traveling gears. Different traveling gear strategies can hereby be realized. All traveling gears can thus be orientated toward a common steering center, for example. Alternatively, two traveling gears can also be set to a common steering center beneath the ring elements, while the further traveling gear is steered separately beneath the boom.

Further features, details and advantages of the invention will be explained in more detail with reference to an embodiment shown in the drawing.

BRIEF DESCRIPTION OF THE FIGURES

FIGS. 8A, 8B, and 8C show a schematic representation for illustrating the movement of the crane on corresponding travel paths.

DETAILED DESCRIPTION

Figure 1:
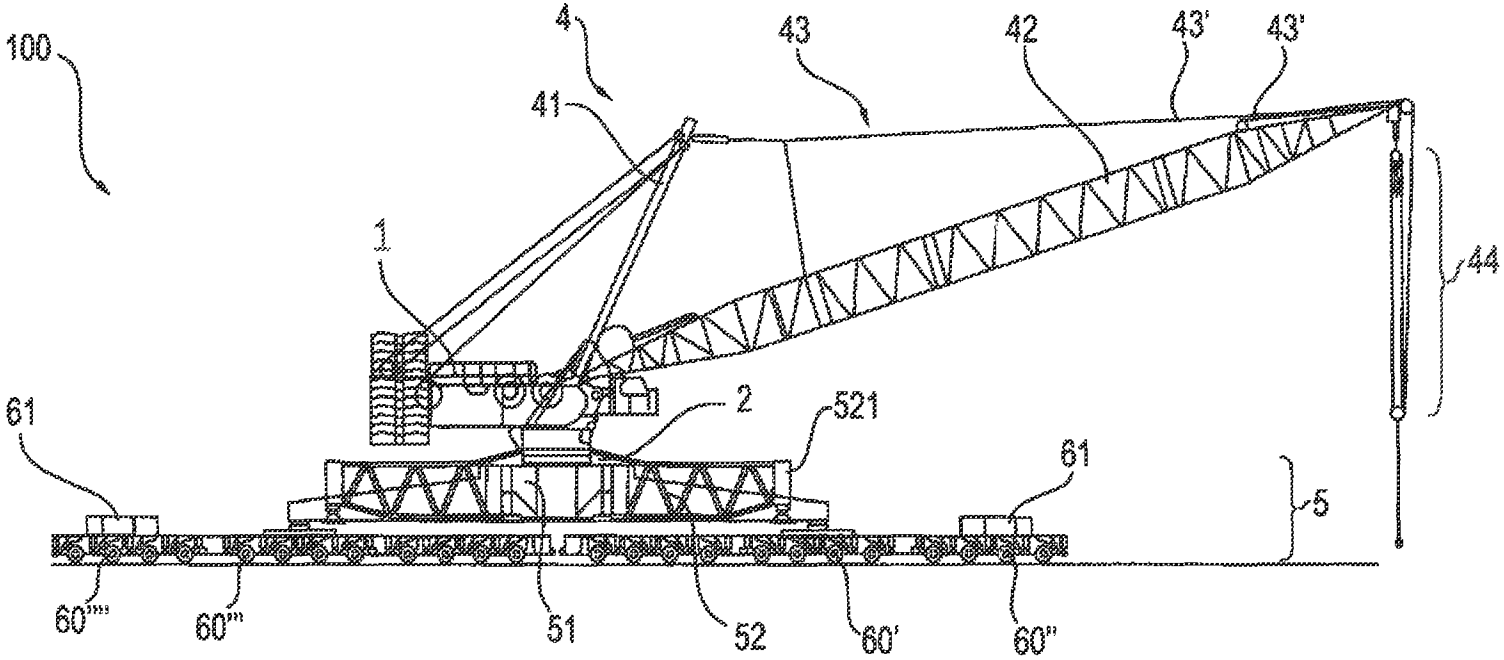
FIG. 1 shows a side view of a crane in accordance with the invention in accordance with its first embodiment.

In the embodiment of the crane 100 in accordance with the invention shown in FIG. 1, the superstructure 1 of a large crane is shown which is connected to an undercarriage 5 via a swivel connection 2. The superstructure 1 has a luffable boom 3. A luffing cabling 4 is provided as a drive for luffing the boom 3. The luffing cabling 4 in accordance with the example shown here has a guying frame 41, a derrick boom 42, a fixed guying 43, which comprises different stay poles 43', and an adjustment block 44. The boom 3, which is not shown in the illustration in accordance with FIG. 1, can be a lattice boom or a telescopic boom, such as is already known in the prior art. As a telescopic boom, it could comprise both a sheet metal construction and a lattice construction.

The superstructure 1 is connected to an undercarriage 5. The structure of the undercarriage 5 is based on a completely novel concept. The interface between the superstructure 1 and the undercarriage 5 is a central pot 51. The pot 51 is the central element which forwards the forces from the superstructure 1 into the remaining undercarriage 5 and finally into the ground on which the crane is set up.

Figure 2:
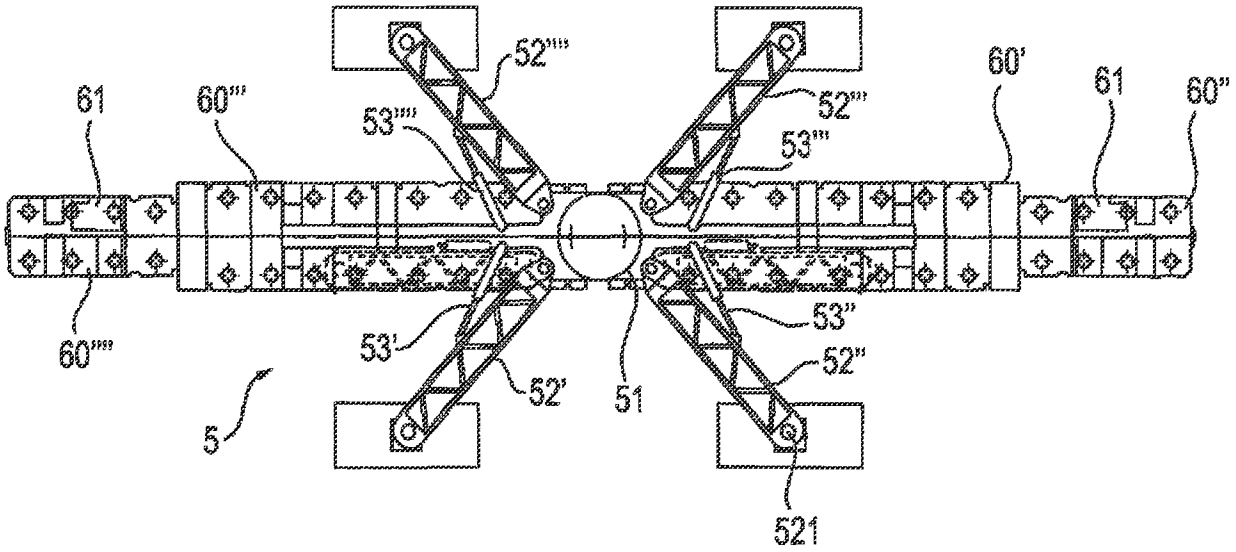
FIG. 2 shows a plan view of a part of the crane in accordance with FIG. 1.

Supports 52 (cf. FIG. 2) are pivotably connected to the pot 51. The supports 52 can be pivotably connected to the pot 51 as is known per se from the mobile crane field. Such a pivotable design of the supports 52 is shown in the embodiment of FIGS. 1 and 2. Pivot drives 53 in the form of hydraulic cylinders are provided here. The function of the support of the undercarriage corresponds to the known support such as is already sufficiently known from the mobile crane field.

Figure 3:
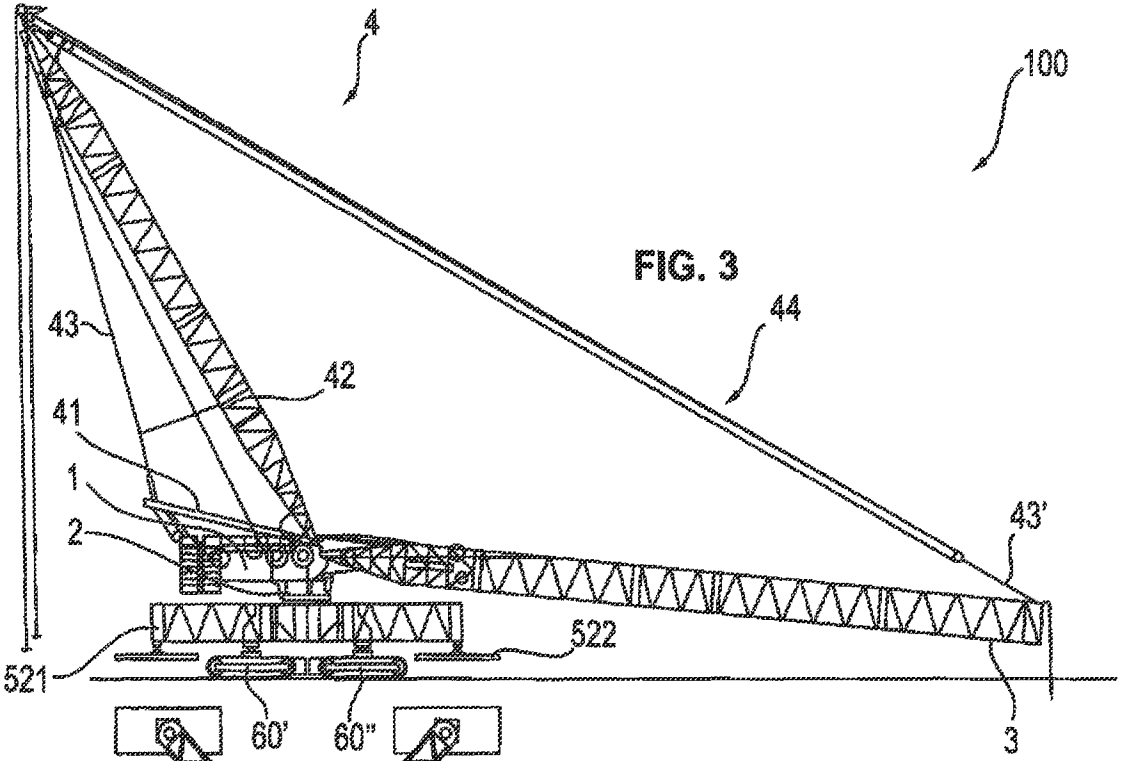
FIG. 3 shows a side view of a crane in accordance with the invention in accordance with a second embodiment.
Figure 4:
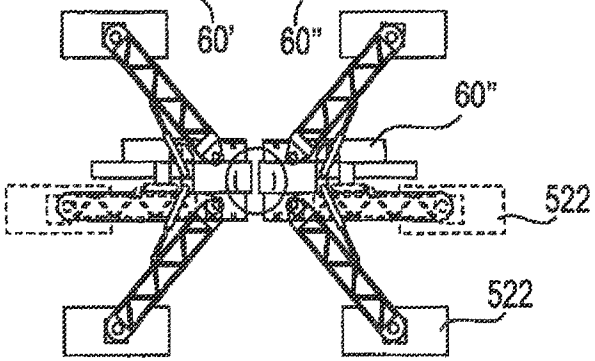
FIG. 4 shows a partial plan view of the crane in accordance with FIG. 3.

To be able to move the crane 100 on the construction site, an external traveling gear 60 is provided. In general, the traveling gear 60 can be configured as a wheel traveling gear, as shown here in the embodiment in accordance with FIGS. 1 and 2, or also as a crawler traveling gear, such as shown in the embodiment in accordance with FIGS. 3 and 4.

It is of particular advantage if a standard traveling gear having its own drive units 61 is provided. If the supports 52 are pivoted outwardly, the traveling gear 60 can, as shown in the Figures, travel through the supports 52 and can be positioned in a connection position with the pot 51.

Side members 54 which are disposed opposite one another with respect to the pot 51 are attached to the pot 51. This can in particular be seen from FIG. 2 or also from FIG. 4. The side members 54 provide a sufficient spacing so that at least two traveling gears 60 can move the crane 100 on the construction site. The side members 54 can in another respect each be connected in a boltable manner to the pot 51. The connection of the side members to the traveling gears takes place over a plurality of degrees of freedom, where possible. This is necessary since a moving of the crane admittedly also frequently takes place over travel paths 70 on the construction site, but these travel paths are nevertheless also bumpy so that corresponding measures have to be taken to avoid a tilting of the crane during the transport.

Figure 5:
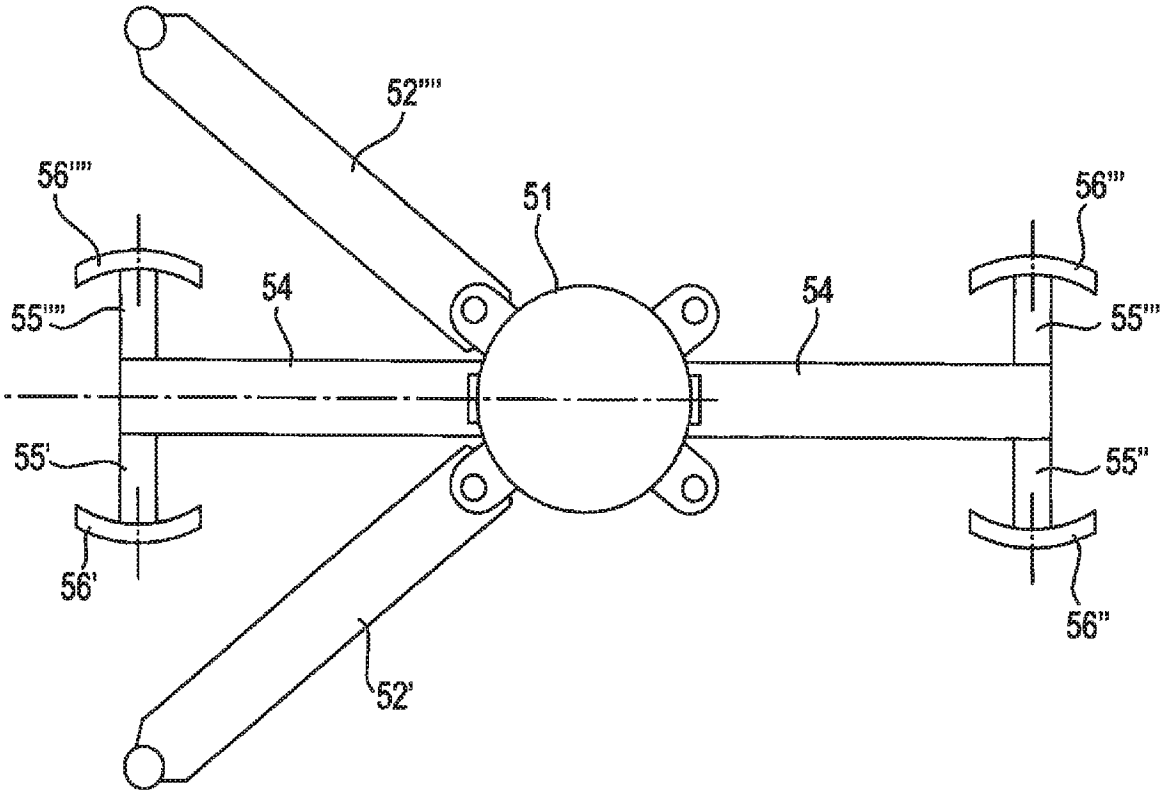
FIG. 5 shows a schematic representation of a part of the crane in accordance with FIG. 1.
Figure 6A:
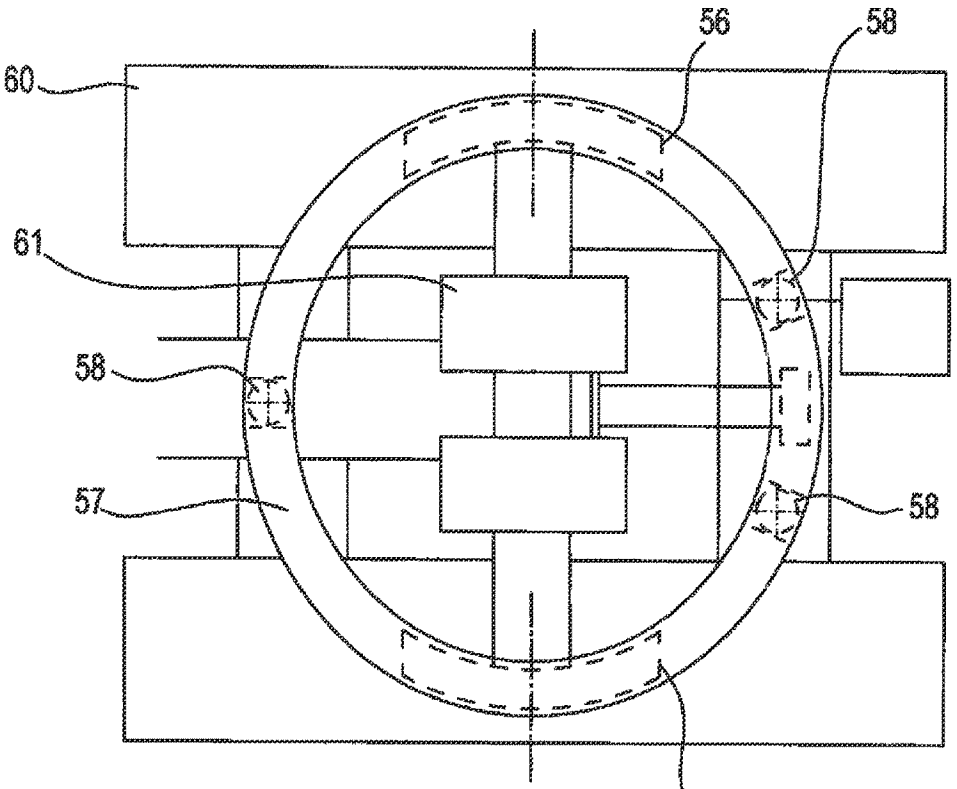
FIG. 6A shows a further schematic representation of a further detail of the crane in accordance with FIG. 3.
Figure 6B:
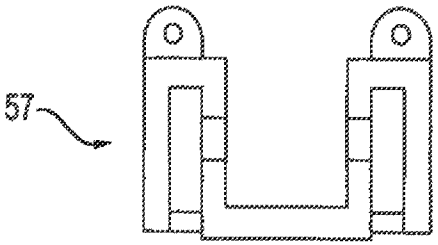
FIG. 6B shows a sectional view through the ring element shown in FIG. 6A.

For this purpose, transverse struts 55 are attached to the side members 54 and are connected to sliding shoes 56 (cf. FIG. 5). A ring element 57 is attached to the traveling gear 60 as a mating connection element. The corresponding sliding shoes 56 of the transverse struts 55 slide in the ring element 57. Each traveling gear 60 can thus rotate beneath the side member 54. As shown with reference to FIGS. 8A, 8B, and 8C, this is necessary during cornering. Compensation for the ground bumps furthermore has to be provided. For this purpose, the ring element 57 is arranged on the traveling gear 60 via a controlled three-point support 58. This three-point support can comprise three main cylinders 58 which hold the ring element 57 in a horizontal plane which is anyway independent of the position of the traveling gear 60 in restricted regions (cf. FIGS. 6A, 6B, and FIG. 8B, in which the ring element is shown). A section through the ring element 57 can be seen from FIG. 6B.

Figure 7A:
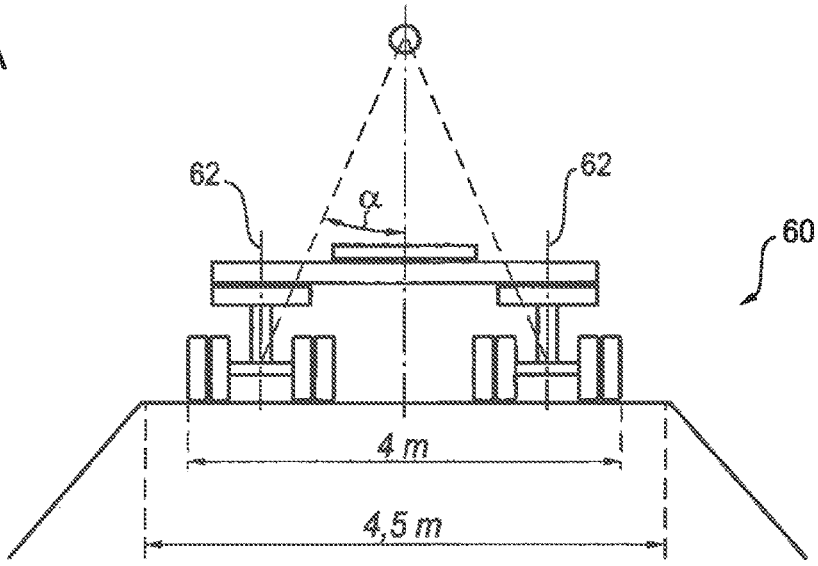
FIGS. 7A, 7B, and 7C show different representations of the traveling gear.

If modular heavy load transport vehicles are used as the traveling gear 60, these driven heavy load transport vehicles 60" and 60"" and non-driven heavy load transport vehicles 60' and 60'" can be used. The non-driven heavy load transport vehicles do not have any structure for the drive units 61 and can thus pivot beneath the crane 100 on cornering. The non-driven heavy load transport vehicles can also be adjustable in their widths. This is shown by way of example in FIGS. 7A, 7B, and 7C. In accordance with FIG. 7A, the width of the non-driven heavy load transport vehicle can thus be increased from 4, meters to 4.5, meters. This is in turn advantageous since the tilt edges 62 can hereby be pushed apart. The tilt edges are formed by the pivot axles of the wheel sets. Each wheel set is tiltable seen on its own.

Figure 7B:
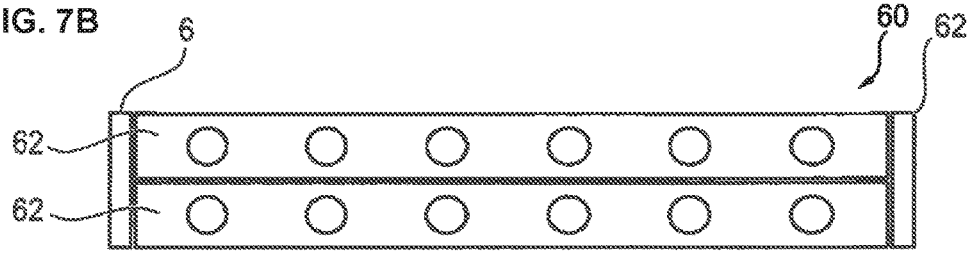
Figure 7C:
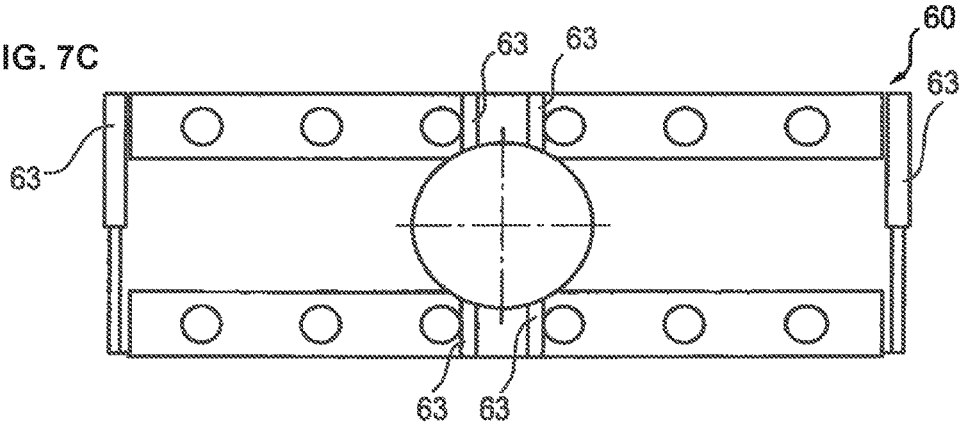
Figure 9:
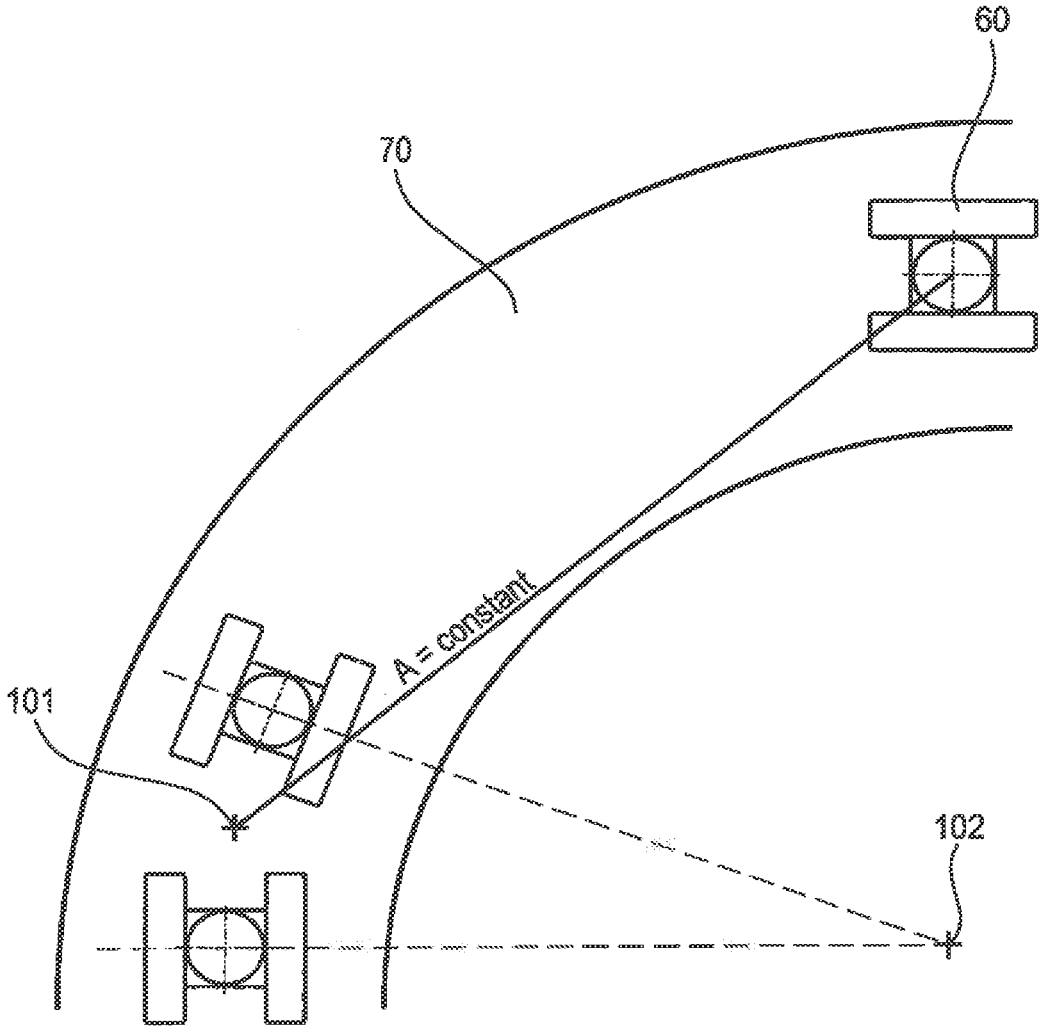
FIG. 9 shows a schematic representation for illustrating a specific travel state of the crane in accordance with the invention.

In FIG. 7B, the non-driven heavy load transport vehicle 60 is shown in a pushed together position in which the width only amounts to 4, meters. In FIG. 7C, in contrast, it is shown in a pushed apart position in which the width in the embodiment shown here amounts to 4.5, meters. The displacement device 63 for adjusting the width of the heavy load transport vehicle is generally already known from the prior art so that it will not be explained in detail again here.

To move the crane 100, it is dismantled until it has reached a movable weight and a movable vertical center of gravity. The traveling gears 60 are positioned beneath the sliding shoes 56. Support cylinders 521, which are provided at the supports 52, are traveled in and the sliding shoes are received in the ring elements 57. If a small travel width is to be reached, the supports 62 can be pivoted inwardly. Alternatively, the supports 52 can, however, also be fully or partially pivoted outwardly, with the support plates 522 advantageously only being raised a little above the ground. If the crane should now reach its tilting range, the supports 52 can come into engagement and prevent a further tilting. This is particularly advantageous when the support 52 is fully inwardly pivoted and the support plates 522 are thus also located above the travel path 50 which likewise has a greater firmness than the ground located next to the travel path. If the support plates 522 are used due to a tilt movement, the support plates 522 are supported on the highly compacted travel path, that is a travel path which can carry more weight. A sinking of the support plates 522 is not to be expected here.

In the embodiment shown here, the supports 52 are configured as a lattice support structure. They are configured to be equally high as the pot 51 vertically. They hereby reach a very high stiffness and the supports can be optimally adapted to the transport window available on the road.

Figure 10:
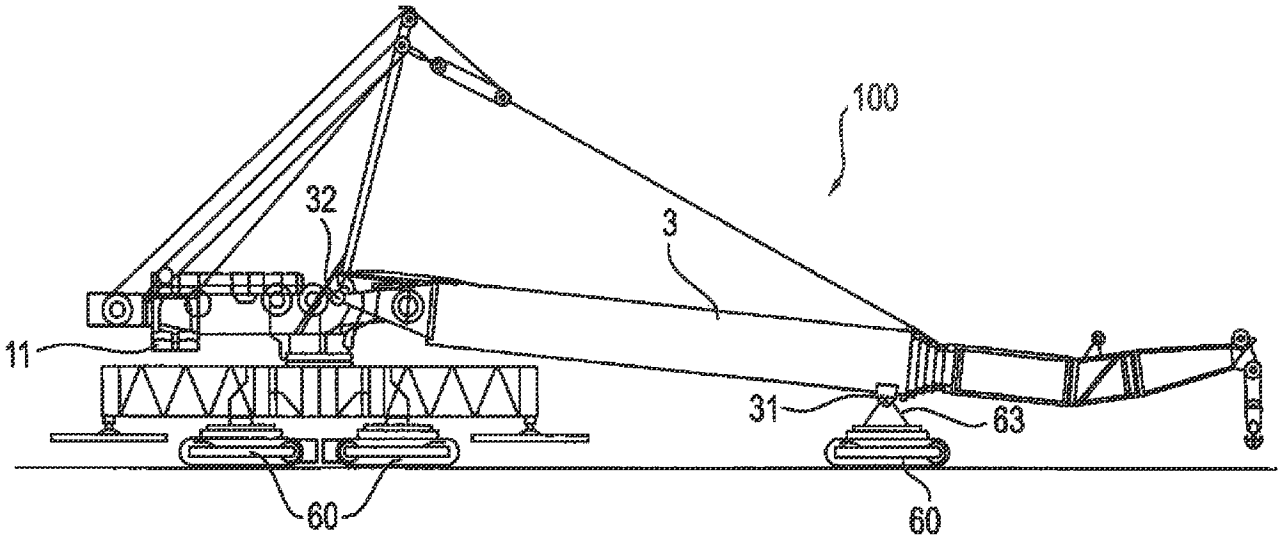
FIG. 10 shows a side view of a crane in accordance with the invention in accordance with a third embodiment.
Figure 11:
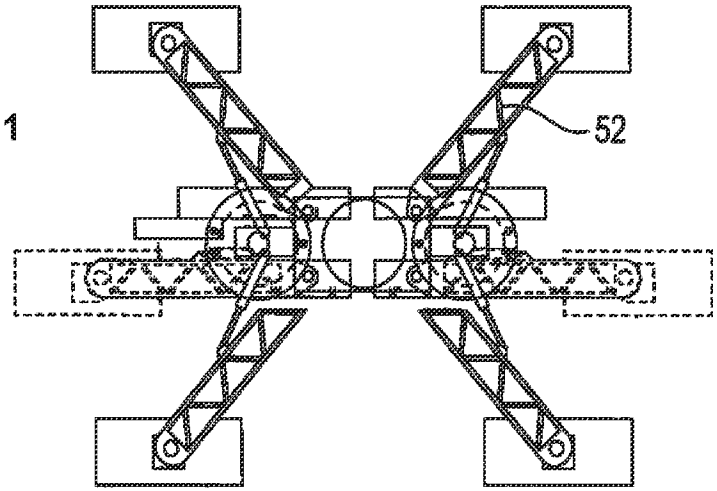
FIG. 11 shows a plan view of a part of the crane in accordance with FIG. 10.

On moving the crane 100, a further traveling gear 60 can be attached beneath the boom 3, as is shown with reference to the embodiment in accordance with FIGS. 10 and 11. For this purpose, connection elements 31 can be provided at the boom 3. They are connected to corresponding mating connection elements 63. The connection allows the required degrees of freedom. The further traveling gear 60 can take up the head weight of the boom 3. The support weight of the boom 3 is introduced into the superstructure via the boom pivot axle 32. To achieve equilibrium here, a little more ballast 11 as to remain on the superstructure 1 in this case. This is advantageously coordinated such that the center of gravity 101 is arranged within the tilt edges 62; the center of gravity 101 is particularly advantageously located within the swivel connection 2. The luffing cabling 4 should not be fully tautened on the moving of the crane. If the luffing cabling were tautened, this could already produce the problem with slight bumps on the travel path 70 that a traveling gear 60 undergoes load relief in an extreme case and is ultimately fully raised. On the other hand, the luffing cabling 4 may also not undergo too great a load relief to prevent a slack rope. Such a slack rope would later negatively influence the winding quality.

Very generally, a support of the boom would also be possible, instead of the traveling gear 60, via a single-axle all-terrain dolly in accordance with German utility model DE 20 2010 002 947, U1.

A specific steering program can be set via a correspondingly provided control for the moving of the crane. Generally different steering programs are possible here. All traveling gears 60 can thus be orientated toward a common steering center 102, for example. It is alternatively possible to set the two traveling gears 60, such as are shown in FIGS. 10 and 11, beneath the ring elements 57 to a common steering center 102, whereas the further traveling gear 60 which is arranged beneath the boom 3 is steered separately. In the latter case, it would have to be considered by the control that the spacing between the rotational axle of the superstructure 1 from the connection point is kept constant between the connection elements 31 and the mating connection elements 63.

Figure 12:
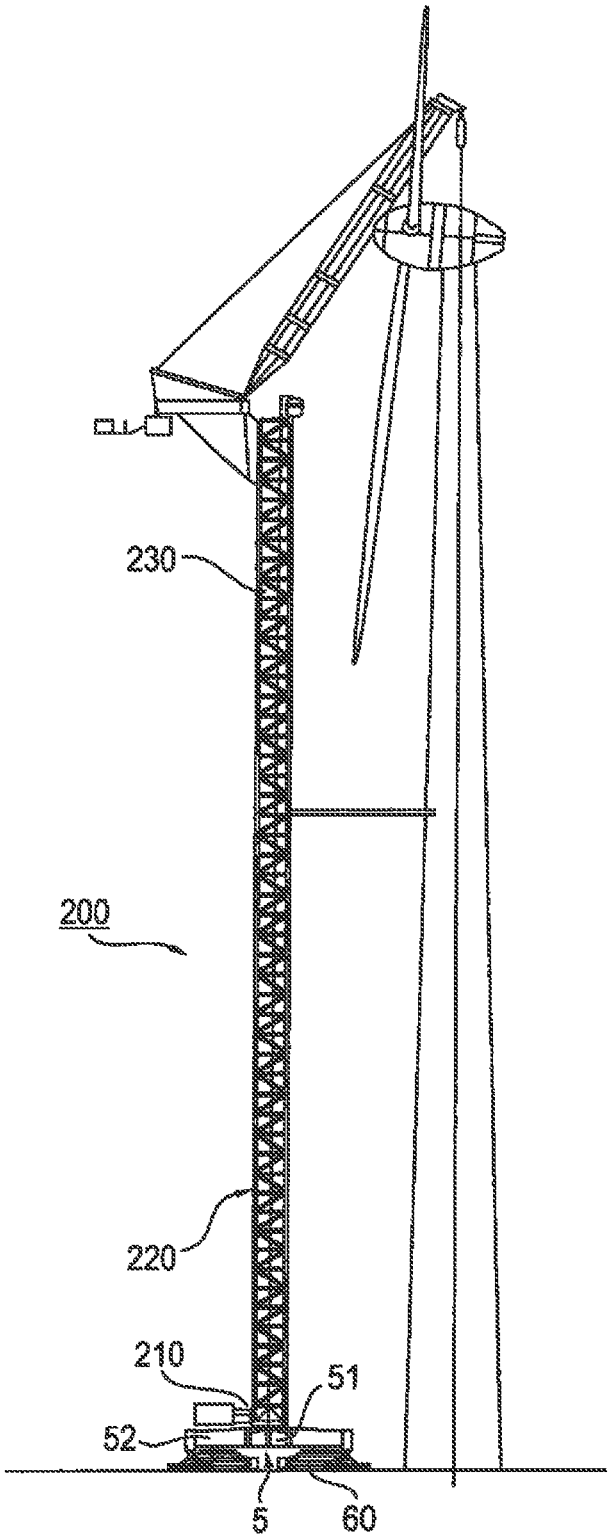
FIG. 12 shows a side view of a crane in accordance with the invention in accordance with a fourth embodiment.

FIG. 12 shows a further embodiment of the crane in accordance with the invention. A mobile crane 200 having an undercarriage 5 and a superstructure 210 is provided here. It has a perpendicularly standing tower 220. The tower comprises a plurality of tower elements 230. Each tower element can be connected to at least one adjacent tower element. As shown in FIG. 12, such a mobile tower slewing crane can be used advantageously to erect high wind turbines.

Here, the superstructure 210 is therefore substantially configured as a tower 220 of a tower slewing crane 200. The tower slewing crane is set up on the undercarriage 5 which is equipped with a corresponding support apparatus.

Figure 13:
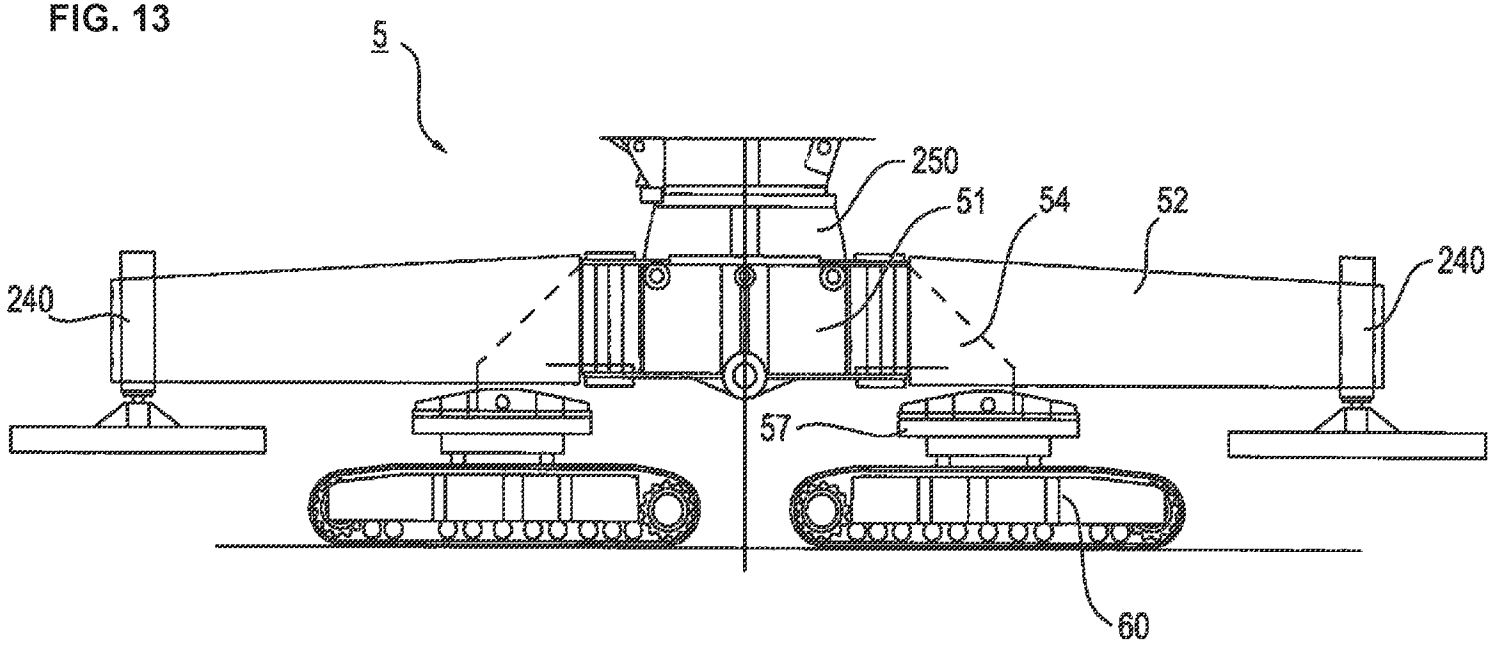
FIG. 13 shows the undercarriage of the fourth embodiment variant.

The setup of the undercarriage can be recognized better in the enlarged detailed representation in accordance with FIG. 13. The support apparatus comprises two times two supports 52 which are each connected to one another via half a pot 51 and which each alone represents a transport unit. The two pot halves are assembled and bolted to one another for assembly, as is shown in FIG. 13. The swivel connection for the bottom-slewing tower 220 of the mobile tower slewing crane 200 is formed together with a mounted and connected revolving deck frame 250.

Figure 15:
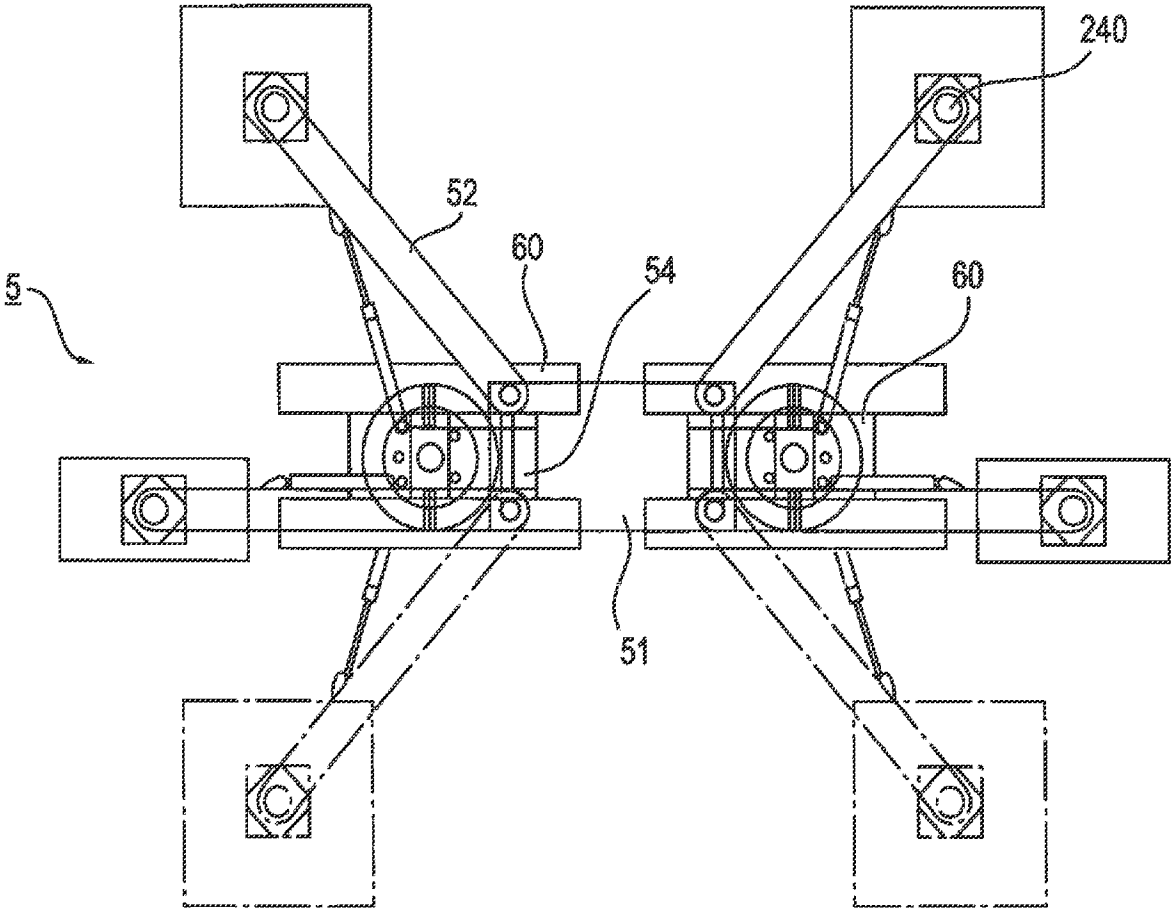
FIG. 15 shows a plan view of an undercarriage in accordance with FIG. 13 with traveled out supports.

The supports 52 comprise a total of four hydraulic support cylinders 240 with automatic leveling. As shown in FIG. 15, a total support base of, for example, 16×16, meters is thereby achieved. Different sizes can naturally be achieved with a corresponding design of the support cylinders used. A support cylinder pair is shown in the lower part of the representation in FIG. 15, on the one hand, retracted in the transport position and, on the other hand, in the moved out support position.

A respective side member 54 adjoins each pot half 51 (cf. FIG. 13); a mounting ring or ring element 57 is provided at it which can be moved below by suitable traveling gears, which are here configured as transport crawlers 60.

Figure 14:
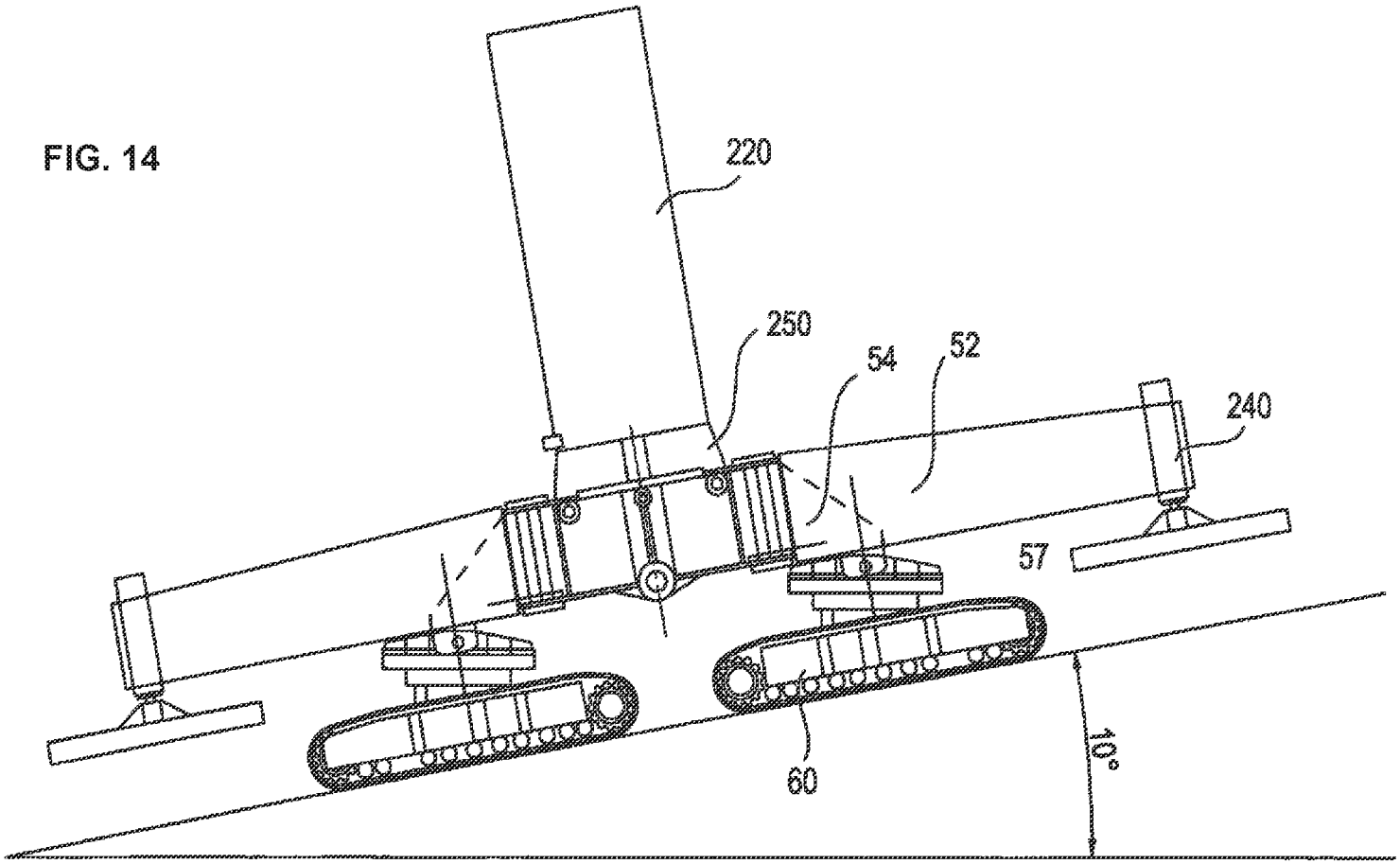
FIG. 14 shows the undercarriage in accordance with FIG. 13 during operation on a gradient.

The crane 60 can thus be supported with the aid of its support apparatus in stationary operation. For displacement, the crane 200 can then be taken up by the at least two traveling gears 60 configured as crawlers and can be moved from one deployment location to another. As can be seen from FIG. 14, gradients with a transverse slope can also be traveled by an automatic horizontal orientation of the support plates forming or receiving the receiving rings or ring elements 57.

Figure 16:
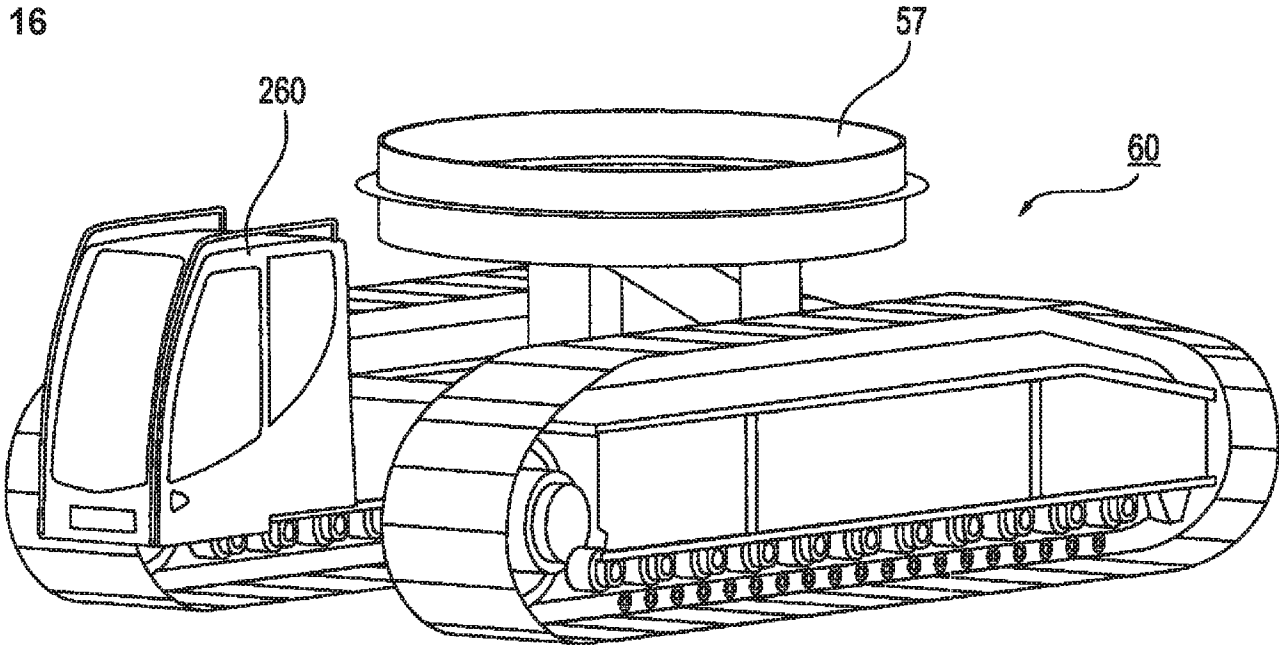
FIG. 16 shows a perspective representation of an embodiment of a traveling gear.
Figure 17:
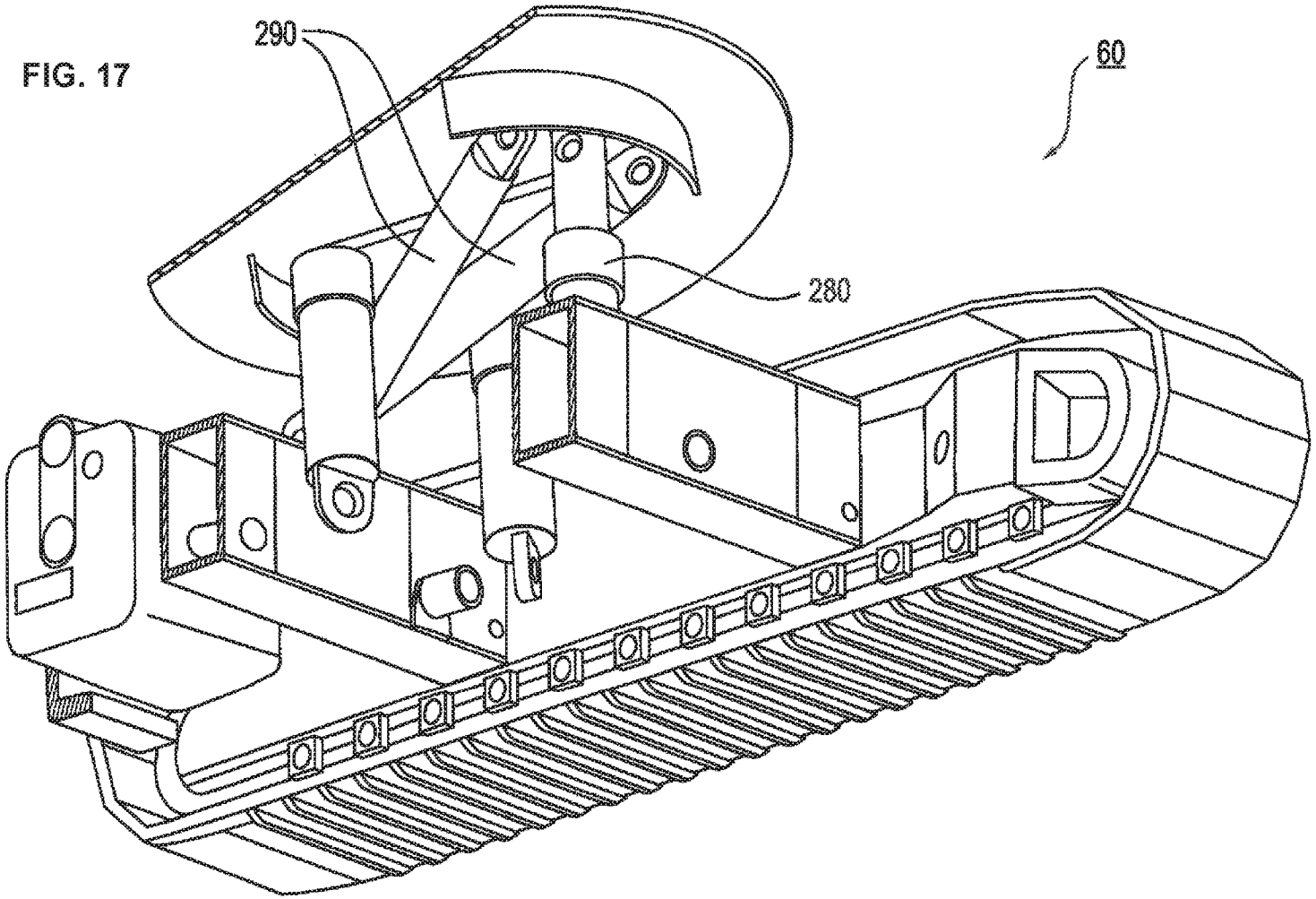
FIG. 17 shows a detail of the traveling gear in accordance with FIG. 16 for explaining the realized three-point support.

FIG. 16 shows a perspective representation of a traveling gear which is here configured as a transport crawler 60 with its own operator's cabin 260. It has a pivotable support plate forming or receiving the receiving ring or the ring element 57. The pivoting takes place via a three-point support which can be recognized in detail in the partly exposed representation in accordance with FIG. 17. The three-point support is here formed by three piston-in-cylinder units 280. In addition, two connectors 290 are provided which take up the forces which are not directed into the longitudinal axes of the cylinders.

The crane 200 cannot only be transported by the traveling gears. It can rather also be received by the traveling gears 60 during the crane operation, with it then additionally be supported via the support apparatus. If the crane 200 should, however, only be supported by the support apparatus, the traveling gears can be used in another manner on the construction site. They can thus, for example, be used for transporting parts of the wind turbine.

A revolving deck is provided on the undercarriage, i.e. more exactly on the swivel connection of the undercarriage, and represents the connection piece between the undercarriage and the center piece with a rotary roll connection and slewing gears. The revolving deck additionally comprises a diesel engine with a generator and hydraulic pumps for the operation of the hydraulic support cylinders. A cable drum is furthermore provided on the revolving deck for the supply of the climbing frame.

The crane tower is secured using the connection piece so that the crane is configured as bottom-slewing. The individual lattice pieces are bolted to one another, with the respective bolts being spring loaded.

The further structure of the superstructure configured as a tower slewing crane results from the detailed description of the simultaneously filed German patent application of the applicant, the content of which is referenced here.

The invention claimed is:

1. A crane having an undercarriage, a swivel connection, and a superstructure rotatably supported thereon via the swivel connection, the crane comprising:

at least one boom system arranged at said superstructure and luffable about a luffing axis or a self-climbing tower slewing crane rotatably supported thereon via the swivel connection;

the undercarriage having a pot as a central component, the pot receiving the swivel connection;

the pot further having pivotably connected supports and having side members at oppositely disposed sides; and at least one respective traveling gear connected to the side members, the connection of the at least one respective traveling gear to the side members including a plurality of degrees of freedom, wherein transverse struts having sliding shoes, rolls, or rollers are arranged at the side members which cooperate with complementary ring elements at a traveling gear side such that the at least one respective traveling gear rotates beneath the side members; and wherein a ring element of the complementary ring elements is arranged on the at least one respective traveling gear via a controlled three-point support, wherein the latter advantageously comprises three hydraulic cylinders via which the ring element is held in a horizontal position independently of a position of the at least one respective traveling gear.

2. The crane in accordance with claim 1, wherein the supports and the side members are releasably connected to the pot, and wherein each side member is coupled to two opposing transverse struts, the transverse struts each having a sliding shoe disposed thereon.

3. The crane in accordance with claim 1, wherein the side members are releasably connected to the at least one respective traveling gear.

4. The crane in accordance with claim 1, wherein the pot is divided into two parts, with each part of the pot being releasably connected to the at least one respective traveling gear via the side members.

5. The crane in accordance with claim 4, wherein the two parts of the pot form the swivel connection together with a revolving deck frame.

6. The crane in accordance with claim 4, wherein the two parts of the pot are releasably connected to each other.

7. The crane in accordance with claim 1, wherein modular driven or non-driven heavy load transport vehicles are the at least one respective traveling gear.

8. The crane in accordance with claim 1, wherein the at least one respective traveling gear is configured as crawler traveling gears.

9. The crane in accordance with claim 8, wherein the at least one respective traveling gear includes tracks, and wherein each of the three hydraulic cylinders is coupled to the at least one respective traveling gear and a bottom side of the ring element.

10. The crane in accordance with claim 9, wherein the at least one respective traveling gear further includes a drive unit, and wherein the at least one respective traveling gear further includes one or more connections disposed at an oblique angle between the ring element and the at least one respective traveling gear and configured to absorb forces which are not directed longitudinally to the hydraulic cylinders.

11. The crane in accordance with claim 1, wherein the at least one respective traveling gear is a first traveling gear and wherein, during movement, the side members are supported by the first traveling gear and the boom system is supported via a second, additional traveling gear, with the second traveling gear coupled via connection elements.

12. The crane in accordance with claim 11, wherein during movement, the undercarriage is additionally supported by one or more separate traveling gears, and wherein during movement the undercarriage is connected to the boom system.

13. The crane in accordance with claim 1, wherein the supports are configured as lattice constructions which have substantially the same height as the pot.

14. The crane in accordance with claim 1, wherein a control is provided for common control of the at least one respective traveling gear.

15. The crane in accordance with claim 1, wherein the at least one respective traveling gear is positioned completely beneath the sliding shoes, rolls, or rollers.

16. The crane in accordance with claim 15, wherein the side members are releasably connected to the at least one respective traveling gear.

17. The crane in accordance with claim 16, wherein the transverse struts include sliding shoes, the sliding shoes slidingly engaging a ring element.

18. The crane in accordance with claim 17, wherein each ring element is mounted above one traveling gear by a three-point support, said three-point support comprising three mount points coupled by hydraulic cylinders to said traveling gear; and wherein the hydraulic cylinders are actuated to maintain the ring element in a horizontal position independently of a position of the traveling gear.

19. The crane according to claim 1, wherein the sliding shoes have an outer perimeter in the shape of a circular arc, and wherein two sliding shoes slidingly engage with each respective complementary ring element.

20. The crane according to claim 19, wherein the sliding shoes rotate relative to the respective complementary ring element when a direction of travel of the at least one respective traveling gear changes.

* * * * *